US008460487B1

(12) United States Patent
Keren et al.

(10) Patent No.: US 8,460,487 B1
(45) Date of Patent: Jun. 11, 2013

(54) METHOD FOR DESENSITIZING LIQUID EXPLOSIVES AND DETONABLE FLAMMABLE LIQUIDS

(75) Inventors: Benjamin Keren, Yuvalim (IL); Yael Cohen-Arazi, Kfar Vradim (IL); Edith Sokol, Naharia (IL); David Fischer, Nahariya (IL)

(73) Assignee: Rafael, Advanced Defense Systems Ltd, Haifa (IL)

( * ) Notice: Subject to any disclaimer, the term of this patent is extended or adjusted under 35 U.S.C. 154(b) by 996 days.

(21) Appl. No.: 12/486,377

(22) Filed: Jun. 17, 2009

(30) Foreign Application Priority Data

Jun. 18, 2008 (IL) ..... 192264

(51) Int. Cl.

| | |
|---|---|
| ***C06B 45/00*** | (2006.01) |
| ***C06B 45/12*** | (2006.01) |
| ***C06B 25/00*** | (2006.01) |
| ***C06B 25/34*** | (2006.01) |
| ***C06B 25/10*** | (2006.01) |
| ***D03D 23/00*** | (2006.01) |
| ***D03D 43/00*** | (2006.01) |

(52) U.S. Cl.
USPC ..... 149/109.6; 149/2; 149/14; 149/88; 149/92; 149/101

(58) Field of Classification Search
USPC ..... 149/109.6, 2, 14, 88, 92, 101
See application file for complete search history.

(56) References Cited

U.S. PATENT DOCUMENTS

| | | | | |
|---|---|---|---|---|
| 1,973,559 | A * | 9/1934 | Brown | 558/484 |
| 4,435,232 | A * | 3/1984 | Ciaramitaro et al. | 149/2 |
| 4,767,476 | A * | 8/1988 | Gebauer | 149/109.6 |

FOREIGN PATENT DOCUMENTS

| | | |
|---|---|---|
| GB | 731 427 | 6/1955 |
| GB | 746 826 | 3/1956 |
| GB | 830 843 | 3/1960 |

* cited by examiner

*Primary Examiner* — James McDonough
(74) *Attorney, Agent, or Firm* — Vorys, Sater, Seymour and Pease LLP; Susanne M. Hopkins

(57) ABSTRACT

A method of desensitization of a sensitive liquid is provided, which includes the continuous stirring of the sensitive liquid with an inert liquid.

14 Claims, No Drawings

METHOD FOR DESENSITIZING LIQUID EXPLOSIVES AND DETONABLE FLAMMABLE LIQUIDS

—This application claims the benefit of prior IL patent application number 192264 filed Jun. 18, 2008, the contents of which are hereby incorporated by reference in their entirety.—

This application claims the benefit of Israeli Application No. 192264, filed on Jun. 18, 2008.

FIELD OF THE INVENTION

This invention relates to a method and apparatus for desensitizing sensitive liquids, particularly explosives and detonable flammable liquids for the purpose of transportation and/or storage.

BACKGROUND OF THE INVENTION

Most modern explosives are reasonably stable and require percussive shock or other triggering devices for detonation. Energetic materials are especially vulnerable to elevated temperatures, with possible consequences ranging from mild decomposition to vigorous deflagration or detonation. Energetic materials can also be initiated by mechanical work through friction, impact, or electricity (e.g., current flow, spark, electrostatic discharge, or electromagnetic radiation). Other stimuli (e.g. chemical incompatibility) can have consequences ranging from mild decomposition to detonation.

The sensitivity of explosives, especially liquid explosives, to any kind of heat, impact, friction, electrostatic discharge or shock poses a serious problem in their handling, transporting and storing. There are few methods known in the art for desensitizing liquid explosives in order to facilitate their safe handling and storing. Thus far, desensitization of liquid explosives has generally been accomplished by the addition of some type of a diluent which lowered the shock sensitivity by solvation to the point where the liquid explosives could be handled with reasonable safety. The diluents were either water soluble, volatile compounds, such as acetone and ethyl alcohol or water-insoluble, nonvolatile compounds, such as triacetin and dimethylphthalate.

However, these kinds of diluents posed serious hazard in the storing and transporting of such desensitized liquid explosives. When using volatile solvents, evaporation could occur, resulting in a progressive sensitization with a relative increase in shock sensitivity. Furthermore, if any of the desensitized explosive is inadvertently spilled, the volatile diluent quickly evaporates leaving the highly sensitive explosive for disposition.

British Patent No. GB 731427 discloses a desensitized solution comprising at least one normally highly explosive, liquid, nitric ester and as a desensitizing agent, a liquid, water-soluble substantially nonvolatile compound being capable of subsequent removal by water extraction.

Another method for the desensitization of an explosive is disclosed in British Patent No. GB 746826, which method comprises forcing the explosive material under a pressure less than 20 times the pressure existing on the explosive in the ambient.

British Patent No. GB 830843 discloses a method for the manufacture of explosives based on liquid explosive nitric esters in which a liquid explosive nitric ester and water are piped separately to an emulsifier and the resulting emulsion transported through a pipe or pipes. The method of reducing the hazard in the transport of the resulting emulsion when a hazardous change in its condition has been indicated consists cutting off the flow of nitric ester to the emulsifier and continuing but diverting the flow of the water in such a way that it passes through the emulsifier and the emulsion transport pipe or pipes to a wash tank.

LIST OF CITATIONS

GB 731427
GB 746826
GB 830843

SUMMARY OF THE INVENTION

The present invention is based on the finding that sensitive liquids such as highly-sensitive shock-explosives or detonable flammable liquids could be efficiently desensitized in order to enable their safe storage, transport or general handling, and may be recovered readily in pure form for subsequent use. The method and apparatus of the invention minimize or completely diminish some of the problems associated with previously described methods for dilution or desensitization of liquid explosives, as briefly described above.

Accordingly, in one aspect of the present invention there is provided a method for desensitizing a sensitive liquid comprising:

mixing (e.g., admixing) at least one sensitive liquid with at least one liquid material; and continuously stirring (e.g., mixing) said mixture (e.g., admixture), wherein said at least one liquid material is immiscible with said at least one sensitive liquid (without the stirring inducing sensitization of the sensitive liquid), thereby desensitizing said sensitive liquid.

In some embodiments, the method comprises:

obtaining at least one sensitive liquid;

obtaining at least one liquid material, being immiscible with said at least one sensitive liquid;

adding said at least one sensitive liquid and said at least one liquid material to each other to obtain a mixture; and continuously stirring said mixture, (the stirring does not induce any sensitization) thereby obtaining a desensitized sensitive liquid.

The sensitive liquid and the liquid material may be added to the container in which desensitization is to be achieved in any sequence and in any way suitable under the specific conditions and without producing any sensitization elements (e.g., air bubbles, introduction of impurities, electric/electrostatic charges) which may initiate an explosion. The addition may be of the sensitive liquid into the liquid material in a mixing container or vice versa. The addition may be while stirring one of the two liquids or prior to the initiation of such stirring.

When the mixture of the at least two components is formed while stirring, the active stirring reduces or substantially diminishes the sensitivity of the at least one sensitive liquid and thereby forms a substantially stable, i.e., desensitized, liquid. The term "sensitive liquid" relates to a liquid explosive or detonable flammable liquid, or mixtures thereof, which upon exposure to one or more of heat, impact, friction, electrostatic discharge or shock, undergoes a very rapid, self-propagating, heat-producing decomposition or explosion. A "desensitized liquid" is thus a liquid which is insensitive to any one of heat, impact, friction, electrostatic discharge or shock, and thus does not undergo any decomposition or explosion The liquid explosive is selected, in a non-limiting fashion, from astrolite, 1,2,4-butanetriol trinitrate, ethylene glycol dinitrate, isopropyl nitrate, methyl ethyl ketone peroxide, methyl nitrate, nitroglycerin, panclastite, and propylene glycol dinitrate.

The detonable flammable liquid is selected, in a non-limiting fashion, amongst mono- or multinitro (polyniro) aliphatics. Non-limiting examples of nitro aliphatic liquid explosives are nitromethane, nitroethane, nitroethylene, and poly-nitro derivatives thereof (namely, having two or more nitro groups, e.g., dinitri, trinitro, tetranitro, etc) tetranitromethane, tetranitroethane, and Picatinny Liquid Explosive (PLX).

In some embodiments, said detonable flammable liquid is nitromethane.

The "liquid material", in comparison to the sensitive liquid, is not, e.g., an explosive or a detonable liquid of any class. As used in the context of the present invention, the term relates to a material which is an inert liquid at room temperature, which is un-reactive towards the liquid explosive or under the desensitizing conditions employed. The liquid material is immiscible with the sensitive liquid, namely the two liquids do not dissolve in each other and each does not solvate, emulsify or form a single homogeneous phase with the other. Upon continuous stirring of the mixture containing the sensitive liquid and the liquid material, a two-component mixture (volume) is formed which upon discontinuation of stirring separates into two distinct phases. These two phases are readily separable from one another.

The at least one liquid material is selected from a silicon-based liquid, a natural oil, a mineral oil, a liquid paraffin and a low viscosity liquid polymer. Non-limiting examples of such a liquid material are PDMS (poly-dimethylsiloxane), glycerin, polyethylene glycol, ethylene glycol and liquid paraffin.

In some embodiments, said at least one liquid is a silicon based liquid.

In some embodiments the mixture comprises at least 10% vol. of the at least one sensitive liquid. In some other embodiments, the mixture comprises between at least 10% and 60% vol. of the at least one sensitive liquid.

In some further embodiments, the mixture comprises 40 to 60% vol. of the at least one sensitive liquid.

In still further embodiments of the invention, the density of the liquid material is different from the density of the sensitive liquid. In some embodiments, the density of the liquid material is lower than the density of the sensitive liquid, so that upon the discontinuation of the stirring, the liquid material forms the upper phase and the sensitive liquid forms the lower phase of the two-phase volume, so as to allow decantation of the sensitive liquid from the bottom part of the mixing container.

In further embodiments, the density of the sensitive liquid is lower than the density of the liquid material, so that the sensitive liquid may be drained from the top of the mixing container.

The term "continuous stirring" or any lingual variation thereof, as used in the context of the present invention, relates to incessant, permanent and uninterrupted stirring (mixing) of the mixture of the two liquids from the point and moment of commencement of stirring until such a point in time when stirring is discontinued for the purpose of reestablishing sensitivity. The stirring may be reinitiated at any time thereafter, e.g., after draining some of the liquid explosive. Thus, the term refers also to any period of such continuous stirring, be it to the time of use of the complete volume of the sensitive liquid or to any intermediary point of time.

The continuous stirring of the two liquids may be achieved by any type of stirring or mixing known to a person skilled in the art. It is desirable that the continuous stirring is preformed in such a way to avoid, for example, the presence of air bubbles, electrostatic charges caused by the rotation of the mixture in the container, introduction of impurities from an external source, and/or impurities from an internal source, as such can initiate explosion or a rapid, self-propagating, heat-producing decomposition. Thus, in some embodiments, the stirring is carried out in an explosion-proof (ex-proof) system, pneumatically or electrically driven.

In some embodiments, depending on the volume of the mixture, the stirring/mixing is achieved by mechanical mixers, electrical mixers, or magnetic stirrers. The mixing or stirring may be performed in small scale or large scale depending on the volume of the explosive which desensitization is required. For example, the mixing may be performed in a small size container (e.g. containers suitable to hold several milliliters to several liters of the mixture) equipped with a mixing rotor, or in a truck-mounted mixer for transporting large quantities (e.g., between several liters and several hundred of liters) of the desensitized liquid. As will be further disclosed hereinbelow, the mixing may be by a mixing unit which is mounted within the container.

In yet another aspect of the present invention there is provided a method of safely transporting and/or storing a sensitive liquid, said method comprising continuously stirring, while transporting and/or storing, a mixture of at least one sensitive liquid and at least one liquid material; wherein said at least one liquid material is immiscible with said at least one sensitive liquid. The stirring does not induce any sensitization.

Within the context of the present invention, the expression "safely transporting and/or storing" refers to the ability to transport the sensitive liquid from a point of origin to a certain destination, being a final destination or a station destination, without imposing any risk, associated with the instability of the sensitive liquid, to the driver and crew in charge of said transportation, to bystanders or commuters, and to the environment. The term also refers to the ability to store such sensitive liquids without imposing the same or similar risks.

In a further aspect of the present invention there is provided a method of transporting a sensitive liquid from a point of origin to a destination, said method comprising:

- mixing (e.g., admixing) at the point of origin at least one sensitive liquid with at least one liquid material;
- continuously stirring said mixture (e.g., admixture) of at least one sensitive liquid and at least one liquid material while transporting;
- discontinuing the stirring at the destination;
- allowing the mixture of at least one sensitive liquid and at least one liquid material to phase separate; and
- separating the at least one sensitive liquid from the at least one liquid material;

thereby obtaining the sensitive liquid material ready for use at the destination.

In another aspect of the present invention, there is provided a method for transporting at least one sensitive liquid from a point of origin to a destination, said method comprising:

- adding into a container at the point of origin at least one sensitive liquid and at least one liquid material (at any order);
- initiating stirring within said container, thereby stirring said at least one sensitive liquid and at least one liquid material to obtain a two- or multi-component mixture;
- continuously stirring said mixture while in transport to the destination;
- discontinuing the stirring at the destination;

allowing phase separation of said at least one sensitive liquid from said at least one liquid material; and separating said at least one sensitive liquid from said at least one liquid material;

thereby obtaining said at least one sensitive liquid at the destination ready for use.

In another aspect of the present invention, there is provided a method for storing at least one sensitive liquid, said method comprising:

adding into a container at the site of storage at least one sensitive liquid and at least one liquid material;

initiating stirring within said container, thereby stirring said at least one sensitive liquid and at least one liquid material to obtain a two- or multi-component mixture; and continuously stirring said mixture while in storage.

The methods of the invention, thereby, allow the transport or storage of a sensitive liquid, in a form which imposes no risk to humans, animals and the environment, and provides the sensitive material back without diminishing any of its properties (e.g., explosive properties).

In another one of its aspects, the present invention provides a continuously mixed desensitized liquid comprising at least one sensitive liquid and at least one liquid material; wherein said at least one liquid material is immiscible with said at least one sensitive liquid.

In yet another aspect of the present invention, there is provided a system for desensitization of at least one sensitive liquid, said system comprising a container for holding a mixture of at least one sensitive liquid and at least one liquid material and a mixing unit for continuously mixing said at least one sensitive liquid with at least one liquid material, wherein said at least one liquid material is immiscible with said at least one sensitive liquid and wherein said stirring does not induce any sensitization.

In some embodiments, the system further comprises at least one inlet for inletting at least one sensitive liquid and/or at least one liquid material into said container.

In other embodiments, said system further comprises at least one outlet for draining said at least one sensitive liquid and/or said at least one liquid material. The outlet may be positioned at any part of the mixing container. In some embodiments, the mixing container contains two or more such outlets.

The inlets and outlets of the system are typically made of a material which does not induce any friction or electrostatic charging or compression forces on the sensitive liquid volume being added or drained therethrough. Such materials are known to a person skilled in the art and are commercially available, e.g. berilco, stainless steel, etc.

In some further embodiments, said system further comprises a control unit for controlling the operation of the system, particularly parameters associated with the continuous mixing and being one or more of on/off, speed, temperature, pressure and spill control. The mixing parameters may be controlled from a distance.

An agitating, vibrating or mixing assembly may also be mounted to facilitate continuous stirring of the transported or stored desensitized liquid mixture in the container to prevent phase separation during transport. This may be externally mounted to the container or a mixing element may be extended into the desensitized liquid mixture in the container to mix it from the top, bottom or sides of the container.

The mixing assembly may be operated by an internal combustion engine, electrically, or manually. The mixing assembly and/or any other part of the system of the invention may be operable by the battery of the transporter.

In some embodiments of the invention, the container for holding the desensitized liquid mixture may be filled with the components of said mixture before it is loaded onto a transporter. In such embodiments and depending on the structure and specific utility, the system of the invention may further include some facilities for supporting the container, so it can be moved easily while in the mixing mode. Such facilities may be a cart having a brake to allow its movement to be slowed or stopped by an operator. The cart may also include facilities for securing the container onto the cart.

The system may further comprise a lifting assembly being mounted onto the frame of a transporter for lifting the cart and the container mounted thereto off the ground for transport to the desired destination. The lifting assembly may be a hydraulic lift or electric motor with gears, which can be operated to lift the cart and container off the ground.

According to this aspect of the invention, the system may be mounted or be an integrated part of a transporting vehicle for transporting the desensitized liquid from point of origin to its destination. Non-limiting examples of such transporting vehicles or transporters are cars, trucks, trains, and ships.

In some embodiments, the transporting vehicle is mounted with a single system of the invention.

In other embodiments, the transporting vehicle is mounted with a plurality of such systems.

In further embodiments, the mixing system of the invention is an integrated part of the transporting vehicle.

In still further embodiments, the mixing system is an add-on to a transporting vehicle which may be towed by the vehicle.

The phase separation typically begins immediately after the mixing is discontinued and the mixture comes to a rest. The time, which may be needed to achieve complete phase separation, depends on the type of the sensitive liquid and liquid materials used, their physical characteristics, the temperature of the environment and other factors, which may have an effect on the physical separation. Typically, the separation takes a few seconds or a few minutes, between 30 seconds to 10 minutes, between 1 to 10 minutes, between 1 to 5 minutes or between 1 to 3 minutes.

Once the phases have separated, the actual separation of the sensitive liquid from the liquid material, by way of draining of one of the liquids from the top or bottom of the mixing container, may be achieved through any one outlet of the mixer/mixing container or from any one opening thereof. The separation may be directly into the site, e.g., to be exploded, or into a second container in which, for example, the mixing of the sensitive liquid with another material may be performed.

Within the context of the present invention, the container for holding the desensitized mixture may be any receptacle made of metal, conductive or antistatic plastic or any other suitable material which is explosion proof, inert to the contained mixture and can not accumulate static charges. The container may be of any volume desired for transportation or storing and of any shape as the system employing the container may require.

DETAILED DESCRIPTION OF EMBODIMENTS

In a series of experiments, mixtures of nitro methane and at least one silicon-based, low-viscosity oil (such as DC-200) were prepared at various concentrations. Typically, the mixtures were of 10-70% vol. nitromethane as the sensitive liquid and 30-90% vol. silicon based material as the inert liquid material.

The silicon based oil was first added into a container, typically of a non-sparking material; the nitromethane was next added and mixing was initiated (mixing speed of 150 to 750 rpm), for the desired time interval (for the duration of transportation or storage), by a pneumatic mixing rotor avoiding the formation or introduction of air bubbles or any other sensitizing element.

At the destination, or after storage was discontinued, the mixing was arrested and the mixture was allowed to phase separate. Separation occurred within 30 seconds, with the nitromethane forming the lower phase, enabling its draining from the bottom of the container.

Other mixtures have also been prepared, stored or transported according to methods of the present invention.

The invention claimed is:

1. A method for desensitizing a sensitive liquid, comprising:

mixing at least one sensitive liquid in pure form with at least one liquid material selected from the group consisting of a silicon-based liquid, a natural oil, a mineral oil, a liquid paraffin, and a low viscosity liquid polymer, to form a mixture, the at least one liquid material being immiscible with the at least one sensitive liquid in pure form; and continuously stirring the mixture for a desired time interval thereby desensitizing the sensitive liquid during the desired time interval, to produce a desensitized liquid during the desired time interval, wherein upon discontinuing stirring after the desired time interval, the mixture spontaneously separates into two distinct phases, one being the at least one sensitive liquid in pure form and the other being the at least one liquid material, thereby obtaining the at least one sensitive liquid in pure form.

2. The method according to claim 1, wherein mixing comprises:

obtaining the at least one sensitive liquid in pure form;

obtaining the at least one liquid material, being immiscible with the at least one sensitive liquid; and adding the at least one sensitive liquid in pure form and the at least one liquid material to each other to obtain a mixture.

3. The method according to claim 1, wherein the at least one sensitive liquid in pure form is selected from the group consisting of at least one liquid explosive, at least one detonable flammable liquid, and mixtures thereof.

4. The method according to claim 3, wherein the at least one liquid explosive is selected from the group consisting of astrolite, 1,2,4-butanetriol trinitrate, ethylene glycol dinitrate, isopropyl nitrate, methyl ethyl ketone peroxide, methyl nitrate, nitroglycerin, panclastite, and propylene glycol dinitrate.

5. The method according to claim 3, wherein the detonable flammable liquid is selected from mononitro aliphatics and polynitro aliphatics.

6. The method according to claim 5, wherein the detonable flammable liquid is nitromethane.

7. The method according to claim 1, wherein the at least one liquid material is a non-explosive or indetonable liquid.

8. The method according to claim 1, wherein the at least one liquid material is selected from the group consisting of poly-dimethylsiloxane (PDMS), glycerin, polyethylene glycol, ethylene glycol, and liquid paraffin.

9. The method according to claim 1, wherein the at least one liquid material is a silicon-based liquid.

10. The method according to claim 1, wherein the mixture of the at least one sensitive liquid and the at least one liquid material comprises at least 10% vol. of the at least one sensitive liquid in pure form.

11. The method according to claim 10, wherein the mixture comprises from 10% vol. to 60% vol. of the at least one sensitive liquid.

12. The method according to claim 10, wherein the mixture comprises from at least 40% vol. to 60% vol. of the at least one sensitive liquid.

13. The method according to claim 1, wherein the density of the at least one liquid material is different from the density of the at least one sensitive liquid in pure form.

14. The method according to claim 1, wherein continuously stirring is achieved by an explosion-proof (ex-proof) system, pneumatically or electrically driven.

* * * * *